United States Patent [19]

Neumann

[11] 3,949,586

[45] Apr. 13, 1976

[54] ROLLING MILL FRAME, IN PARTICULAR A UNIVERSAL ROLLING MILL FRAME

[76] Inventor: Klaus Neumann, Am Klosterhang 15, 667 St. Ingberg, Saar, Germany

[22] Filed: Oct. 24, 1974

[21] Appl. No.: 517,514

[30] Foreign Application Priority Data

Oct. 26, 1973 Germany ..... 2353731

[52] U.S. Cl. ..... 72/238

[51] Int. Cl.[2] ..... B21B 31/08

[58] Field of Search ..... 72/238, 239, 237, 225

[56] References Cited

UNITED STATES PATENTS

| | | | |
|---|---|---|---|
| 1,089,126 | 3/1914 | Greg | 72/238 |
| 3,491,570 | 1/1970 | Beard | 72/239 |
| 3,507,136 | 4/1970 | Salzman | 72/238 |
| 3,566,498 | 3/1971 | Kato et al. | 29/148.4 |

*Primary Examiner*—Milton S. Mehr
*Attorney, Agent, or Firm*—John J. Dennemeyer

[57] ABSTRACT

A rolling mill frame has a stand which is pivotal, preferably about a lower horizontal shaft, in order that the roll set together with accessory devices can be removed from the frame in a lateral direction without regard to the width of the window opening in the stand, for the purpose of interchange with a new roll set together with accessory devices thereof.

10 Claims, 4 Drawing Figures

ROLLING MILL FRAME, IN PARTICULAR A UNIVERSAL ROLLING MILL FRAME

This invention relates to a rolling mill frame, especially a universal rolling mill frame, and is more particularly concerned with a rolling mill frame having stands provided with window openings which are smaller than the diameters of the rolls supported in the rolling mill frame, and having chocks for the rolls which chocks are guided in the window openings.

It is accepted that the rolls can be removed only in upward direction from a rolling mill frame constructed in this manner, i.e. that the stands must be constructed in the form of capped stands. This construction, however, provides the advantage of relatively narrow window openings whereby a beneficial effect in respect of the stiffness of the stand is obtained. In practice, however, this advantage is largely disregarded and the window openings are made wide enough that the rolls can be removed in the axial direction thereof on the side of the rolling mill frame remote from the drive.

It is an object of the invention to provide a rolling mill frame from which the rolls can be removed in the axial direction even if the window openings of the stand are smaller than the diameters of the rolls. This object is attained according to the invention in that the stand remote from the driving side is adapted to be pivoted relatively to the chocks guided in its window opening while the roll set to be removed is temporarily supported, in such manner that the roll set can be removed in the axial direction of the rolls.

The location of the pivot axis is immaterial provided it is ensured that the path for removing the roll set is clear after the stand has been pivoted away. For a rolling mill frame with horizontally disposed rolls the pivot axis is preferably horizontal and disposed in the region of the lower end of the stand. This preferred embodiment forms the basis for the following detailed description, although it is also envisaged to arrange the roll to be pivotal about a vertical axis. In this case, however, the stand together with its pivot axis must either be displaced horizontally through a distance corresponding to the axial length of the chocks prior to the pivotal movement in order to permit the chocks to leave the window opening, or the guide faces of the window opening as well as those of the chocks must be constructed in a curved manner with the pivot axis as centre of curvature.

In the case of a rolling mill frame having vertically disposed rolls the preferred constructional form of the invention has a vertical pivot axis extending through the stand located opposite the drive side.

Vertically displaceable running rails are provided within the frame for temporarily supporting the roll set to be interchanged prior to the pivotal movement of the one stand. In order that the roll set when resting on these running rails can be removed horizontally in the axis direction of the rolls, the invention further proposes that a removal carriage provided with further running rails can be moved over the pivotally displaced stand and that in the downwardly pivoted position of the stand the further running rails form an extension of the raised running rails of the frame. Although the removal carriage may be arranged to be displaceable in the axial direction of the rolls to be interchanged by placing the further running rails laterally of the pivotally displaced approximately horizontal lying stand, the invention prefers to render the removal carriage displaceable over the downwardly pivoted stand in a direction transverse to the further running rails, and in this case road rails supporting the carriage are laid in a removable manner. These road rails — at least the road rails disposed closest to the frame — must be removable in order to permit the stand to be pivoted down into a position under the plane of the further running rails of the transversely displaceable carriage.

If the rolling mill frame is provided with a common drive for the screw-down devices of the two stands, the shaft leading to the screw-down device of the pivotal stand is provided with a coupling means which is released prior to the pivotal movement of the stand. If the common screw-down device is located at the botton, the shaft leading to the pivotal stand must be guided to the stand from the outside by means of angle drives and must be provided there with a coupling means since the parts of the screw-down device located below the pivot axis rotate inwardly during the pivotal downward movement of the stand.

The invention is particularly suitable for use with a universal rolling mill frame having horizontal rolls and vertical rolls disposed in a common vertical plane, and having cross connections between the vertical stand columns which cross connections receive the rolling pressures of the vertical rolls and which are constructed at the same time as guides for the chocks of the vertical rolls. In order to provide such a universal rolling mill frame with a pivotal stand according to the invention, the cross connections are preferably cast integral with the stand located on the drive side and are adapted to be securely fastened to the pivotal stand. The screw-down device for the chocks of the vertical rolls may be constructed in this case in a conventional manner, for example as described in reference to FIG. 3 of German Pat. No. 1129441. In this case the screw-down spindles are guided in bridges connecting the stand columns of a stand and their end faces rest against the chocks. The screw-down spindles can thus be pivoted together with the stand without difficulty.

In an embodiment of the invention, the free end of each cross connection has a face by which it engages the respective stand column of the pivotal stand and is provided with a projection having a transverse bore and arranged to extend through a recess in the stand column, and a fastening bolt displaceable transversely to the projection is mounted on the pivotal stand and is engageable in the bore for securely fastening the cross connection to the pivotal stand, the chocks of the vertical rolls, at least the chocks of the vertical rolls adjacent to the pivotal stand, being arranged to be screwed down against the continuous force of a withdrawal device by means of screw-down spindles which are guided in the stand columns and which have end faces abutting against lateral lugs of the chocks. Each cross connection may be in the form of a twin beam having a pair of oppositely disposed guide paths for the chocks of the vertical rolls, the vertical spacing between two guide paths being greater than the thickness of the chocks by the thickness of wedge-shaped rails adapted to be inserted in the region of the guides.

The twin beams may be utilised for supporting upper and lower entry guide members and for locking them in a centre position, the upper and lower guide members and lateral entry guide members being mounted on the chocks of the vertical rolls for removal together with the roll set.

One embodiment of the invention as applied to a universal rolling mill frame is described below by way of example with reference to the accompanying drawings, in which.

Figure 1:
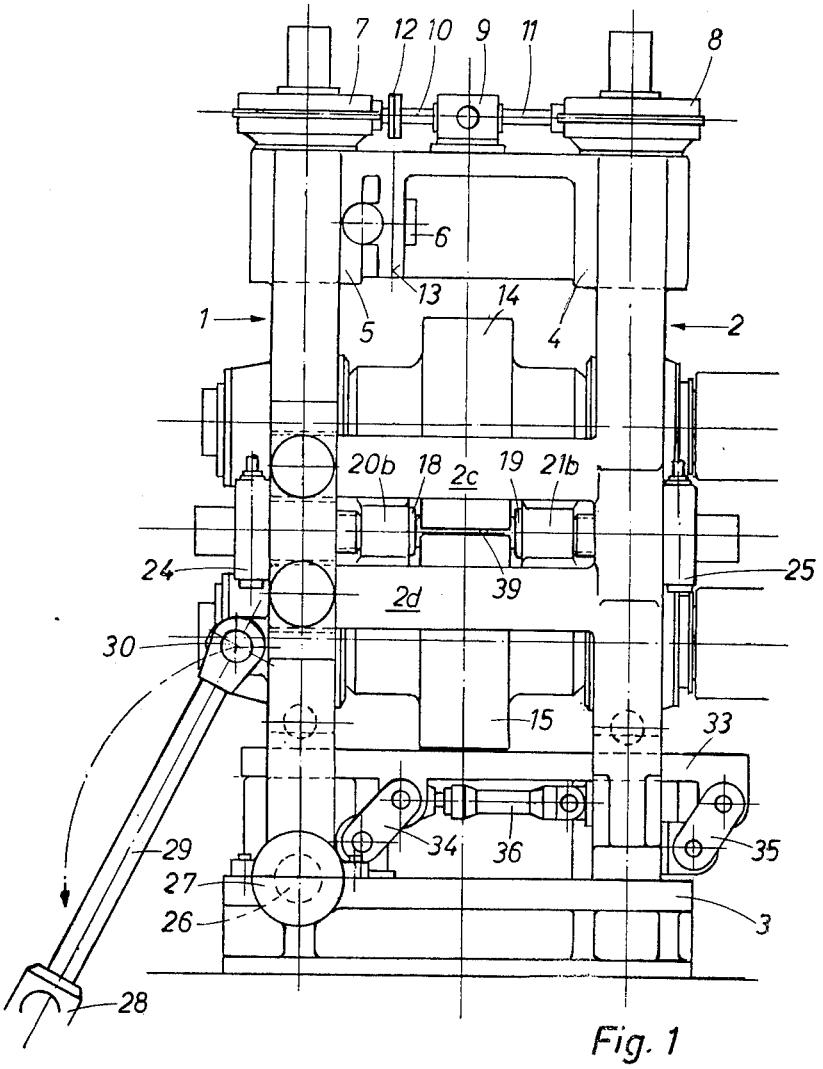
FIG. 1 illustrates a front view of the rolling mill frame ready for operation.
Figure 2:
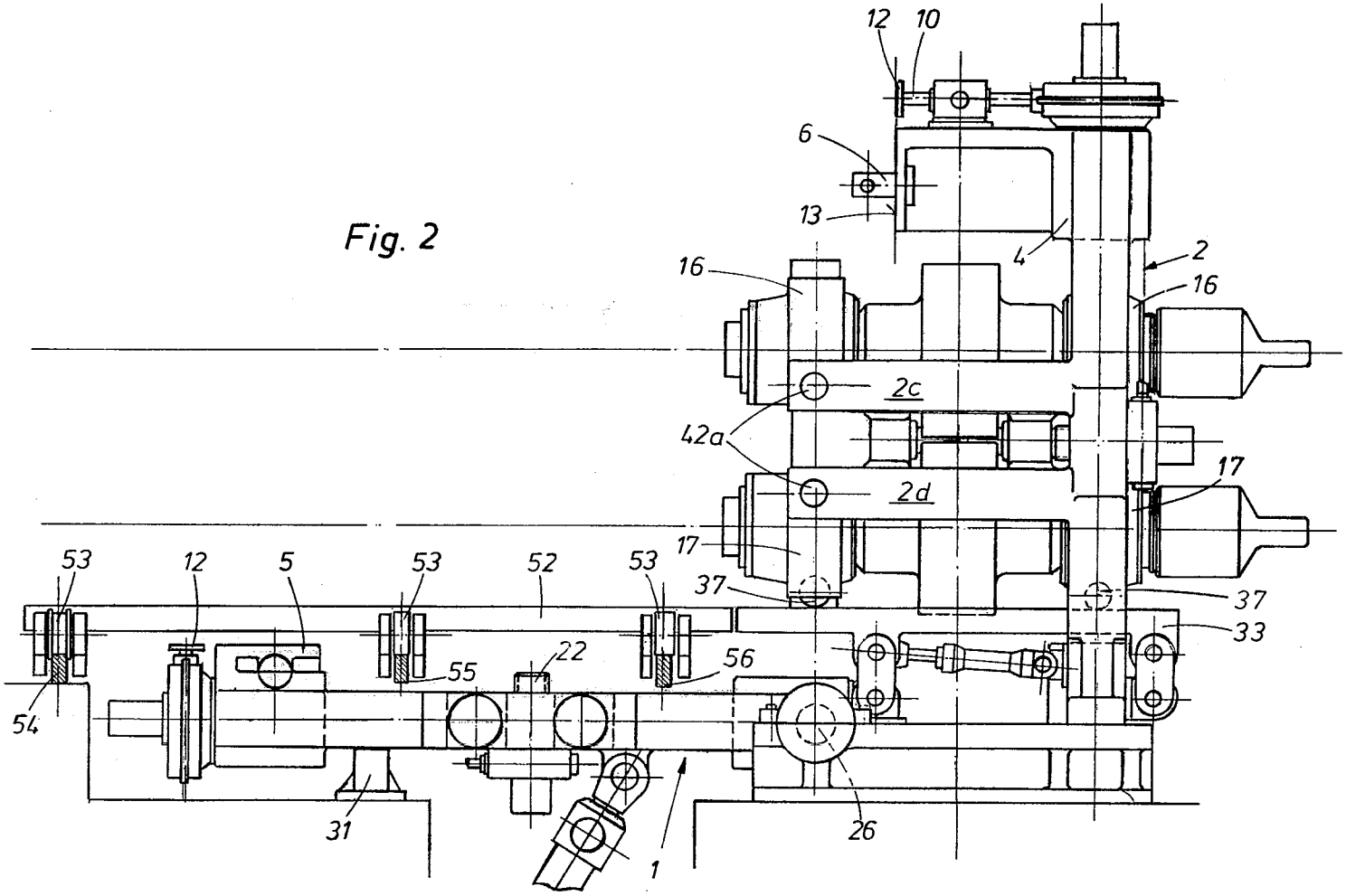
FIG. 2 illustrates a front view of the same rolling mill frame with a downwardly pivoted stand.
Figure 3:
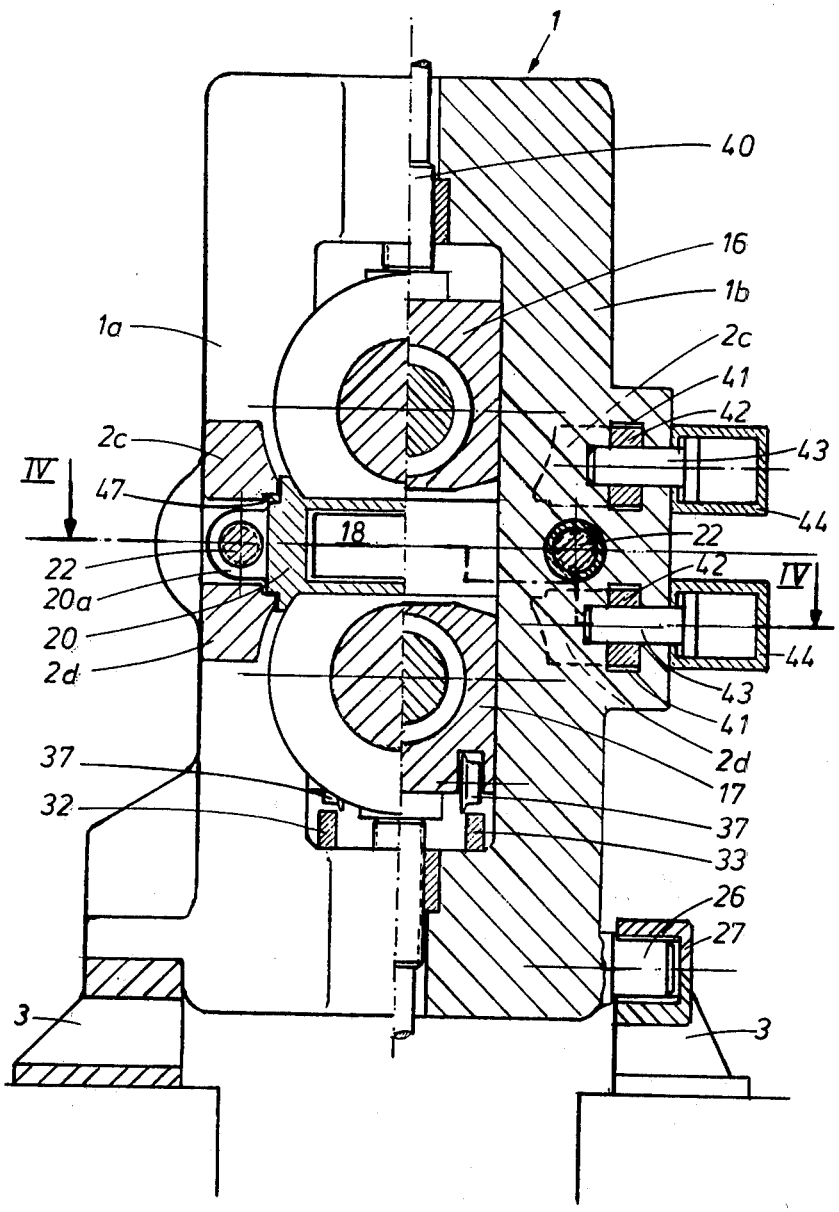
FIG. 3 illustrates a vertical section on the line III—III in FIG. 4.

A rolling mill frame illustrated in FIGS. 1 to 3 comprises two stands 1 and 2 which are supported on base plates 3. Upper transverse yokes of the stands are connected together by a divided bridge having component parts 5, 4 which can be securely fastened together by means of a bolt 6.

Each stand 1, 2 is associated with an upper screw-down device 7, 8 which can be actuated by a common drive 9 having drive shafts 10 and 11. The shaft 10 leading to the stand 1 is interrupted by a coupling means 12 which is disposed in the vertical plane of separation 13 between the bridge parts 4 and 5.

Figure 4:
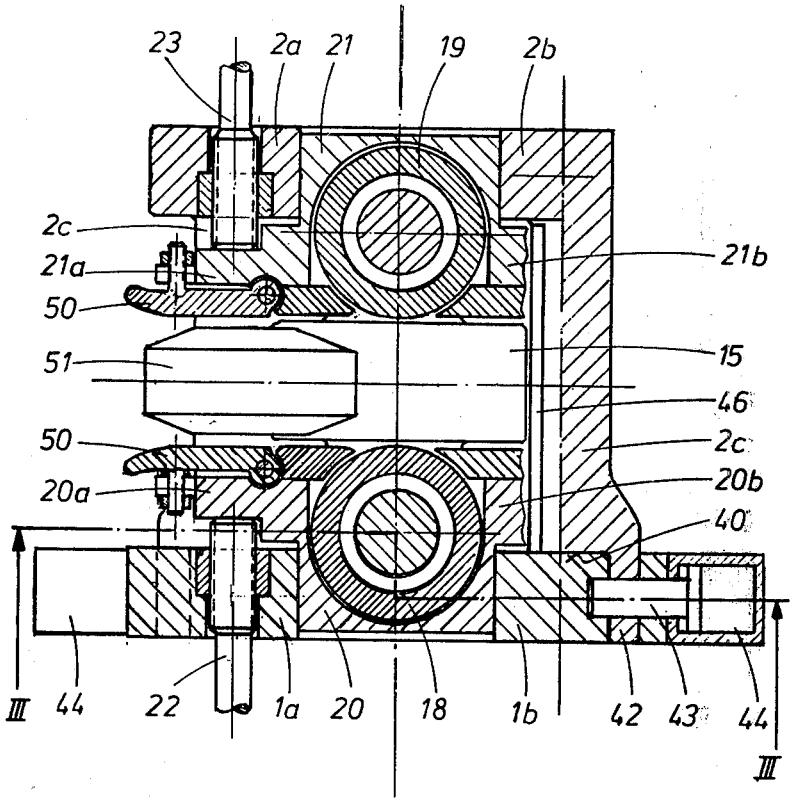
FIG. 4 illustrates a horizontal section on the line IV—IV in FIG. 3.

The roll set to be changed consists of two horizontal rolls 14, 15 mounted in chocks 16, 17 and vertical rolls 18, 19 mounted in chocks 20, 21 (FIG. 4). Furthermore it may be seen from FIG. 4 that the chocks of the vertical rolls are provided with lateral lugs 20*a*, 20*b* and 21*a*, 21*b*, respectively, which are engaged by the end faces of pairs of screw-down spindles 22 and 23, respectively. These screw-down spindles are guided in a novel manner in the stand columns 1*a*, 1*b* and 2*a*, 2*b*, respectively, whereby bridge-like cross connections between the stand columns are avoided which in previously known constructions projected outwardly and guided the screw-down spindles. Gears 24, 25 (FIG. 1) which are driven from above in a manner not illustrated in detail are attached laterally to the stands 1 and 2 and serve for driving the pairs of screw-down spindles 22 and 23, respectively.

The stand 1 of the frame side remote from the drive is pivotal according to the invention about a pivot axis 26 which in the present example is disposed in the lower region of the stand and which is mounted in two pivot bearings 27 of the base plates 3, and the stand can be rotated through approximately 90° into the horizontal position illustrated in FIG. 2. The pivoting drive is in the form of a swingably supported hydraulic cylinder 28 having a piston rod 29 which is connected to the stand 1 by means of a pivot pin 30. In the downward pivoted position the stand 1 is supported by supports 31. Prior to the pivotal downward movement the coupling means 12 of the screw-down device 7 as well as the fastening bolt 6 between the two bridge parts 4, 5 is released. Obviously it is also possible to construct this coupling means in the form of an automatically engaging clutch provided with end teeth, since the screw-down device is not actuated during the changing operation. Furthermore the roll set must be temporarily lifted prior to the pivotal downward movement of the stand 1, for which purpose vertically displaceable running rails 32, 33 are provided within the frame in a known manner. These running rails are supported by parallel motion links 34, 35 (FIG. 1) and can be controlled by a hydraulic cylinder-piston device 36 from the inoperative position illustrated in FIGS. 1 and 3 into the raised operative position clear from FIG. 2, in which they engage from below under running rollers 37 of the lower chocks 17 in which the lower horizontal roll 15 is mounted, and receive the weight of the roll set. For this operation which precedes the pivotal downward movement of the stand 1 it is necessary to raise at least the upper pressure screws 40 of the screw-down devices.

It is known that in a two-high rolling mill frame supports must be inserted between the chocks of the horizontal rolls in order that the roll set can be removed laterally as a unitary structure. In the illustrated universal rolling mill frame measures must be taken in order to include also the chocks of the vertical rolls in the removable roll set unit. The following description is concerned with these measures.

Apart from the window openings of the stands, cross connections between the stands serve for guiding the chocks 20 and 21 of the vertical rolls; each of the cross connections consists of a twin beam 2*c* and 2*d*, respectively, which beams are cast integral with the columns 2*a* and 2*b* of the stand 2, as may best be seen from FIG. 2. These twin beams 2*c* and 2*d* are spaced from each other by a distance which permits material 39 which is to be rolled to pass there between and in which also the lugs 20*a*, 20*b* and 21*a*, 21*b* of the chocks 20 and 21, respectively, of the vertical rolls are accommodated.

It may be seen from the right hand half of FIG. 3 in conjunction with FIG. 4 that the free end of each twin beam 2*c* and 2*d* is provided with an engagement face 400 for the stand columns 1*a*, 1*b* of the pivotal stand 1 and has a projection 42 which extends through a recess 41 (FIG. 3) in the stand column, each projection 42 being provided with a transverse bore 42*a* (FIG. 2). For the purpose of fastening the cross connecting twin beams 2*c*, 2*d* to the pivotal stand 1, a fastening bolt 43 enters into the respective transverse bore 42*a*, the fastening bolts 43 being reciprocable by hydraulic cylinder-piston devices 44. The end of each fastening bolt 43 is preferably made slightly conical (not illustrated) to effect secure fastening without play.

As stated already the twin beams 2*c*, 2*d* of each cross connection rendered tension resistant by the fastening means serve also as guiding beams for the chocks 20 and 21 of the vertical rolls. For this purpose the guide beams — as may be seen from the left hand half of FIG. 3 — have pairs of oppositely disposed guide paths 46, 47 the guide path 46 of the lower beam 2*d* may be seen from above on the right hand side of FIG. 4. These guide paths 46 support the chocks of the vertical rolls and permit sliding movement thereof. Reverting to the left hand side of FIG. 3 it may be seen that a larger vertical spacing exists between the lower guide paths 46 and the respective upper guide paths 47 than corresponds to the thickness of the chocks in the region of their guides. The visible gap under the guide paths 47 serves for inserting therein wedge shaped rails for guiding the chocks of the vertical rolls in a tilt free manner (not illustrated). These wedge shaped rails are removed when the roll set is to be raised by upwardly controlling the running rails 32, 33 for effecting the lateral removal of the roll set. In this case the lower chocks 17 of the lower horizontal roll 15 engage under the chocks 20 and 21 of the vertical rolls so that these are safely supported for removal. In contrast the chocks 16 of the upper horizontal roll 14 are deposited on the chocks of the vertical rolls by releasing a balancing device (not illustrated) so that in the end the whole roll set presents a stable structure. The chocks of the vertical rolls are lifted to such extent that they are clear of their two guide paths 46 and 47.

It may be seen from FIG. 4 that lateral entry guide members 50 are pivotally mounted on the chocks 20, 21 of the vertical rolls. The illustrated lower entry guide member 51 as well as an upper entry guide member (not visible) are also mounted on these chocks for common removal with the roll set; in this case, however, mounting is effected within the chocks 20, 21 of the vertical rolls in such manner that displacement in the axial direction of the horizontal rolls 14, 15 is possible and so that after the entry guide member 51 is secured to the twin beams 2*c* and 2*d* in a central position, a screw-down movement of the vertical rolls 18, 19 together with the chocks 20, 21 is possible without displacement of the entry guide member 51 from its centre position.

FIG. 2 illustrates laterally of the frame a removal carriage which is displaceable transverse to the roll axes and which has a pair of running rails 52 which in the removal position form an extension of the running rails 32, 33 of the frame. The removal carriage may alternatively be constructed in the form of a rapid change device and fitted with two rail pairs in order that a new roll set can be rapidly inserted after the removal of an old roll set. The removal carriage is supported by means of road wheels 53 rolling on road rails 54, 55 and 56, of which the road rails 55 and 56 are laid in a displaceable manner since otherwise the stand 1 cannot be pivoted into and out of the horizontal removal position.

I claim:

1. A rolling mill frame comprising two stands disposed on opposite sides of said frame, each stand having a window opening therein, chocks mounted in said window openings, rolls supported in said chocks, said window openings being smaller than the diameters of said rolls, drive means located adjacent one of said stands on one side of said frame, said other stand on said opposite side of said frame arranged for pivotal movement relatively to said chocks, means for temporarily supporting said rolls to permit said other stand to be pivoted into a position clear of said chocks, and means for removing said rolls from said frame in the axial direction of the rolls while said other stand is in said pivoted position.

2. A rolling mill frame having a drive side, stands having window openings for mounting a set of rolls having diameters greater than said window openings, chocks guided in said window openings, means for pivoting the stand opposite the drive side of said frame relative to said chocks, and means to temporarily support said set of rolls to permit removal thereof in the axial direction of the rolls.

3. A rolling mill frame according to claim 2, wherein when the rolls have a horizontal position and the stand located opposite to the drive side of the frame is pivotable about a horizontal pivot axis disposed in the region of the lower end of the stand.

4. A rolling mill frame according to claim 2, in which said means for temporarily supporting said set of rolls are vertically displaceable running rails located within the frame, and wherein a removal carriage provided with further running rails is displaceable over the downwardly pivoted stand, the further running rails of the removal carriage forming, in the removal position of the stand, an extension of the raised running rails of the frame.

5. A rolling mill frame according to claim 4, wherein the removal carriage is displaceable over the downwardly pivoted stand in a direction transverse to the further running rails by means of road rails supporting the removal carriage, some of the road rails being laid in a displaceable manner.

6. A rolling mill frame according to claim 1, wherein a common drive is provided for screw-down devices of both stands, and wherein a shaft leading to the screw-down device of the pivotal stand is provided with a coupling means.

7. A rolling mill frame according to claim 1 in the constructional form of a universal frame having horizontal rolls and vertical rolls disposed in a common vertical plane and cross connections between the vertical columns of the stands, wherein the cross connections are arranged to receive the rolling pressures of the vertical rolls and are constructed at the same time as guide for the chocks of the vertical rolls, and wherein the cross connections are rigidly connected to the stand on the drive side of the frame and are adapted to be securely fastened to the pivotal stand.

8. A rolling mill frame according to claim 7, wherein the free end of each cross connection has an engagement face for engaging the stand columns of the pivotal stand and has a projection which is provided with a transverse bore and which extends through a recess in the stand column by means of which projections the cross connections can be securely fastened to the pivotal stand in co-operation with fastening bolts which are displaceable in a direction transverse to the projections, wherein the chocks of the vertical rolls at least on the frame side associated with the pivotal stand are actuatable against the continuous force of a withdrawal device by means of screw-down spindles which are guided in the stand columns and the end faces of which rest against lateral lugs of the chocks.

9. A rolling mill according to claim 7, wherein each cross connection is constructed in the form of a twin beam which beams are provided with pairs of oppositely disposed guide paths for the chocks of the vertical rolls, and wherein the vertical spacing between a pair of guide paths is greater by the thickness of insertable wedge shaped rails than the thickness of the chocks in the region of their guides.

10. A rolling mill frame according to claim 9, wherein the twin beams are utilised for supporting upper and lower entry guide members and for securing them in a central position, the entry guide members as well as lateral entry guide members being mounted in the chocks of the vertical rolls in such a manner that they can be removed together with the roll set.

* * * * *